United States Patent [19]

Tomioka et al.

[11] 3,945,230

[45] Mar. 23, 1976

[54] PROCESS FOR AUTOMATICALLY INTERCHANGING DIE ASSEMBLIES IN A METAL WORKING PRESS AND APPARATUS THEREFOR

[75] Inventors: Shozo Tomioka, Komatsu; Shujiro Matsushima, Kanazawa; Yokichi Koezuka; Geniti Tanabe, both of Komatsu; Koichi Nakasyo, Mikawa, all of Japan

[73] Assignee: Kabushiki Kaisha Komatsu Seisakusho, Tokyo, Japan

[22] Filed: Sept. 27, 1974

[21] Appl. No.: 509,907

[30] Foreign Application Priority Data

Sept. 27, 1973 Japan ..... 48-107999

[52] U.S. Cl. ..... 72/30; 29/568; 72/7; 72/22; 72/448; 100/DIG. 18

[51] Int. Cl.[2] ..... B30B 15/00

[58] Field of Search ..... 72/30, 448, 446, 7, 22; 100/DIG. 18; 29/568

[56] References Cited

UNITED STATES PATENTS

| | | | |
|---|---|---|---|
| 3,559,446 | 2/1971 | Dom et al. | 72/448 |
| 3,727,442 | 4/1973 | Ridgway et al. | 72/446 |
| 3,858,286 | 1/1975 | Nuhejl | 29/568 |

*Primary Examiner*—Carl E. Hall
*Attorney, Agent, or Firm*—Armstrong, Nikaido & Wegner

[57] ABSTRACT

Process and apparatus are disclosed for automatically interchanging die assemblies in a metal working press having a pair of moving bolsters to be used alternately in the press. An initial condition setting device having control circuits connected to various portions of the press for setting data such as the number of products, the pressing force of the slide of the press for working, the die height for different die assemblies, the balancer air pressure, the die cushion stroke, the die cushion air pressure, the kind of operation of the die cushion for the drawing, the locking or the shearing and the blank holder air pressure is provided for sequentially carrying out various steps. The steps include moving the bolster having the used die assembly thereon out of the press to a predetermined exterior position after unclamping the die assembly and moving another bolster having a new die assembly to be used next set thereon in position into the press for the next operation and clamping the die assembly to be ready for the next operation with removal of safety pins in the die assembly. The die height adjustment, the die cushion air pressure adjustment are carried out fully automatically during the operation, thereby permitting the changing of die assemblies in the entire press line or the changing of die assembly in an individual press to be automatically carried out while the operation of the operator is simplified and the safety in operation is insured so as to improve the efficiency of the press.

2 Claims, 14 Drawing Figures

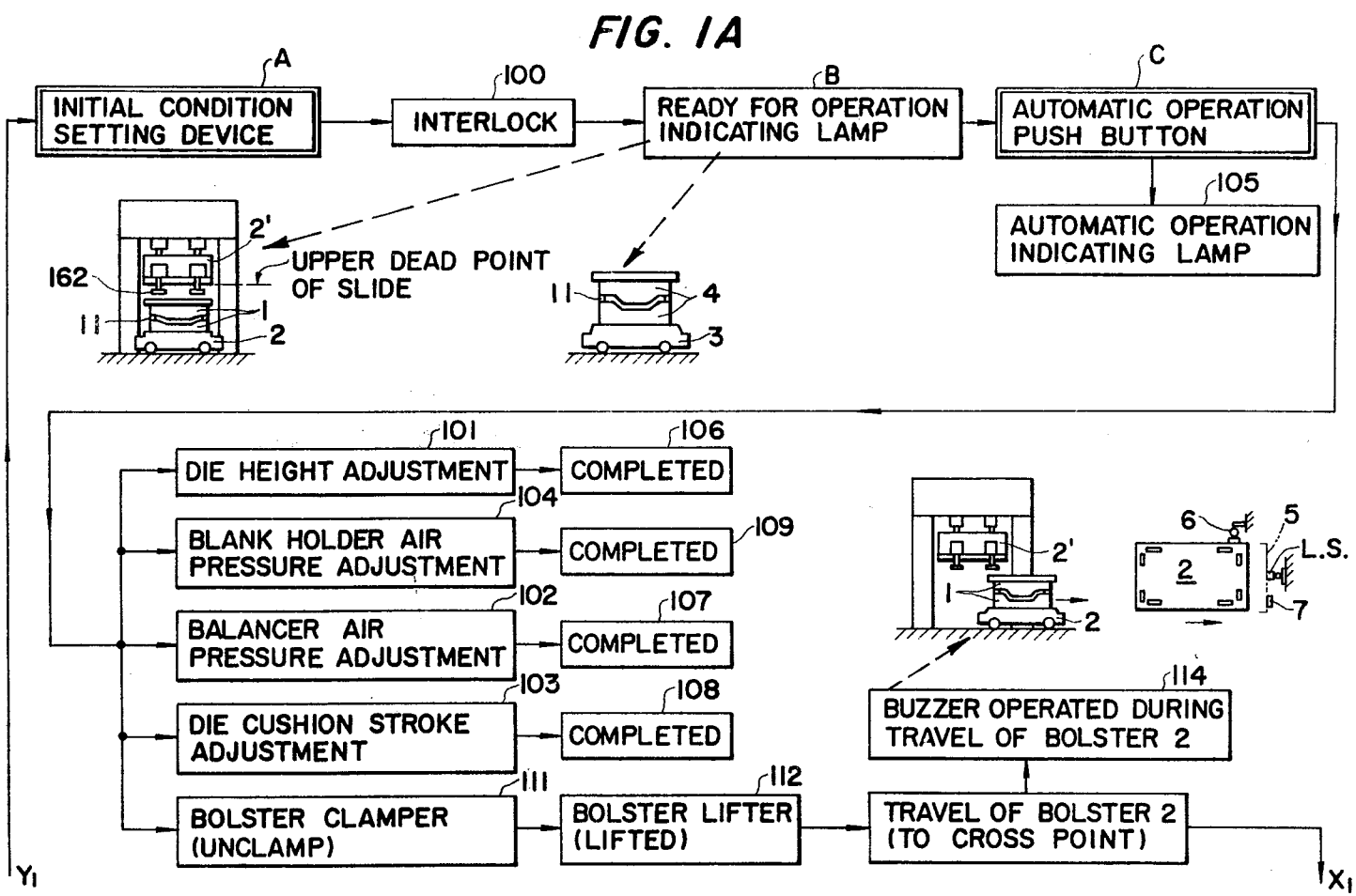
FIG. 1A
A
INITIAL CONDITION SETTING DEVICE
100
INTERLOCK
B
READY FOR OPERATION INDICATING LAMP
C
AUTOMATIC OPERATION PUSH BUTTON
105
AUTOMATIC OPERATION INDICATING LAMP
UPPER DEAD POINT OF SLIDE
162
101
DIE HEIGHT ADJUSTMENT
104
BLANK HOLDER AIR PRESSURE ADJUSTMENT
102
BALANCER AIR PRESSURE ADJUSTMENT
103
DIE CUSHION STROKE ADJUSTMENT
111
BOLSTER CLAMPER (UNCLAMP)
106
COMPLETED
109
COMPLETED
107
COMPLETED
108
COMPLETED
112
BOLSTER LIFTER (LIFTED)
114
BUZZER OPERATED DURING TRAVEL OF BOLSTER 2
TRAVEL OF BOLSTER 2 (TO CROSS POINT)
L.S.
X1
Y1

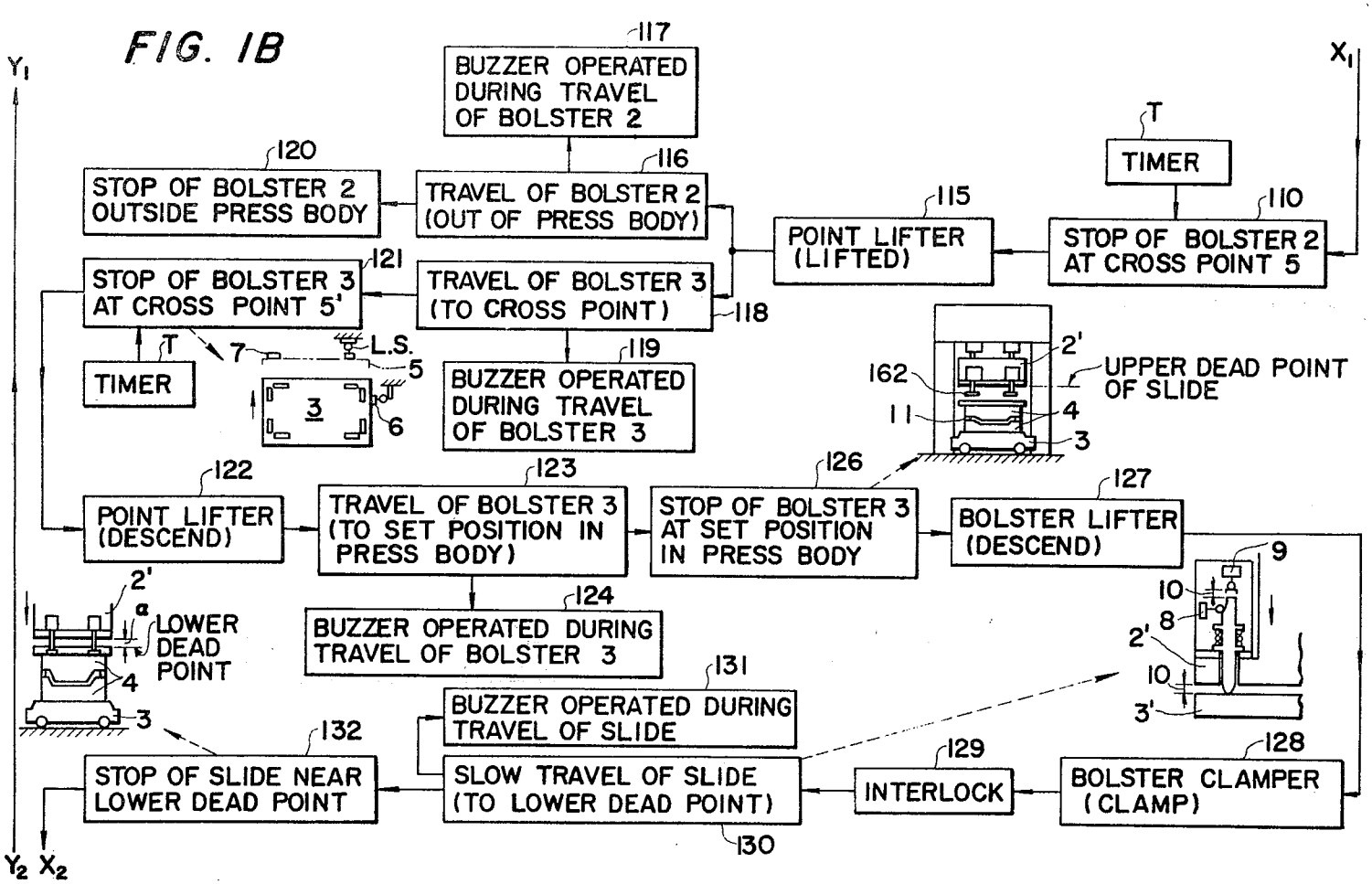
FIG. 1B
TIMER
T
STOP OF BOLSTER 2 AT CROSS POINT 5
110
POINT LIFTER (LIFTED)
115
UPPER DEAD POINT OF SLIDE
BUZZER OPERATED DURING TRAVEL OF BOLSTER 2
117
TRAVEL OF BOLSTER 2 (OUT OF PRESS BODY)
116
TRAVEL OF BOLSTER 3 (TO CROSS POINT)
118
BUZZER OPERATED DURING TRAVEL OF BOLSTER 3
119
STOP OF BOLSTER 2 OUTSIDE PRESS BODY
120
STOP OF BOLSTER 3 AT CROSS POINT 5'
121
L.S.
TIMER
POINT LIFTER (DESCEND)
122
TRAVEL OF BOLSTER 3 (TO SET POSITION IN PRESS BODY)
123
STOP OF BOLSTER 3 AT SET POSITION IN PRESS BODY
126
BOLSTER LIFTER (DESCEND)
127
BUZZER OPERATED DURING TRAVEL OF BOLSTER 3
124
BUZZER OPERATED DURING TRAVEL OF SLIDE
131
SLOW TRAVEL OF SLIDE (TO LOWER DEAD POINT)
130
BOLSTER CLAMPER (CLAMP)
128
INTERLOCK
129
STOP OF SLIDE NEAR LOWER DEAD POINT
132
LOWER DEAD POINT
X1
X2
Y1
Y2

PROCESS FOR AUTOMATICALLY INTERCHANGING DIE ASSEMBLIES IN A METAL WORKING PRESS AND APPARATUS THEREFOR

BACKGROUND OF THE INVENTION

1. Field of the Invention.

The present invention relates to a process for automatically interchanging die assemblies in a metal working press having a pair of moving bolsters alternately used in the press.

2. Description of the Prior Art.

The changing of die assemblies in a metal working press has heretofore been carried out by operating manual push buttons for successively effecting the respective steps of changing die assemblies, switching the operations and effecting adjustment while viewing the parts. However, the die changing operation is very complicated and requires skill and, if the setting of the infeed of the slide for providing the pressing force of the slide during the operation is incorrect, may be overloaded the press thereby resulting in the danger of destroying the die assembly and the parts of the press. Therefore, the die changing operation has been carried out by a skilled die setting man.

SUMMARY OF THE INVENTION

The present invention is developed in view of the above described difficulties in the prior art press.

An object of the present invention is to provide a process for automatically interchanging die assemblies in a metal working press which can be easily carried out by unskilled worker by merely operating a starting push button and in which the respective steps for interchanging the die assemblies can be carried out in parallel to each other without requiring the operation of push buttons and the switching of operations for the respective steps of changing the die assemblies.

Another object is to provide an apparatus for carrying out the above described process.

A further object is to provide a process and apparatus of the type described above by which the die change operation in the entire press line or the die changing operation in individual presses can be simultaneously and fully automatically carried out.

A still further object is to provide a process and apparatus of the type described above in which the die interchanging operation in a press having a pair of bolsters alternately used in the press can be carried out in parallel to each other thereby permitting the time required for the changing of the die assembly to be extremely shortened and the efficiency of the operation of the press line to be extremely improved.

A further object of the present invention is to provide a process and apparatus of the type described above by which the operation required for the operator is simplified so that safety is insured thereby preventing the damage to the die assembly and the parts of the press, while no skilled operator is required for the operation of the present invention.

The above objects are achieved in accordance with the present invention by the provision of a process for automatically interchanging die assemblies in a metal working press having a first moving bolster located in position in the press and mounting thereon a die assembly consisting of an upper die and a lower die which have been used in the preceding operation of the press with the slide of the press being located at the upper dead point thereof. A second moving bolster is located in position in the exteriorly set position and mounting thereon a die assembly consisting of an upper die and a lower die which are to be used in the next operation of the press. The process comprises the steps of effecting die height adjustment for providing a set clearance to the slide for the next die assembly, balancer air pressure adjustment, die cushion stroke adjustment and blank holder air pressure adjustment for the next die assembly according to the respective set values set for the next operation of the press upon receipt of signal of interlocking for operating the first and second moving bolsters, moving the first bolster out of the press in position to the exteriorly set position, moving the second bolster in position in the press, moving the slide having been located at the upper dead point downwardly to the lower dead point for securing the adapter attached to the upper die mounted on the second bolster to the slide by the clamping action of the die clamper of the slide, moving the slide again to the upper dead point for effecting simultaneously die height readjustment for applying a pressing force to the slide, lifting of die cushion pad and die cushion air pressure adjustment, carrying out the pressing operation for the number of products set preliminarily, moving the slide again to the upper dead point for effecting die height adjustment for providing clearance for the next die assembly, descending of the die cushion pad upon receipt of signal of interlocking for operation of the press and the first and second moving bolsters, moving the slide to the lower dead point for separating the adapter attaching thereto the upper die from the slide by the unclamping action of the die clamper, moving the slide to the upper dead point for effecting again the first mentioned step, and interchanging the die assembly on the first moving bolster located at position in the exteriorly set position by a new die assembly to be used next during the time the above described steps are being effected, wherein all the operations included in the above described steps are automatically carried out in accordance with the demand preliminarily set thereby permitting the changing of the die assembly to be carried out automatically during the pressing operation of the press while operation of the manual push buttons and switching operations are dispensed with so that the time required for changing of the die assembly is extremely shortened.

In accordance with the present invention, an apparatus for automatically interchanging die assemblies in a metal working press having a pair of moving bolsters alternately used in the press is provided which comprises means provided with an initial condition setting device for setting the required die height value and the like and a slide position detecting device capable of actuating a slide driving motor intermittently by means of a timer through a synchronizing control for automatically adjusting the die height and the die cushion stroke, means having a voltage controlled reducing valve unit including check valves and a discharging electromagnetic valve for automatically adjusting the air pressure in air tank for balancer, a die cushion, and blank holder, means having electromagnetic valves and a coupling body for automatically connecting and disconnecting the flow of working fluid from the press body to the die assembly attached thereto, and means having an electromagnetic valve for automatically setting the die protecting clearance in the die assembly by operating safety pins mounted in the die assembly. The first series of operations including the adjustments of the die heights, the blank holder air pressure, the balancer air pressure and the die cushion stroke and the movement of the moving bolsters out of and into the press body, the second series of operations including clearance adjustment for operation of the die assembly, removal of the safety pins, die height readjustment for applying a pressing force to the slide, lifting of the die cushion pad and die cushion air pressure adjustment and the third series of operations including readjustment of the clearance for protection of the die assembly, locking of the safety pins, the die height adjustment for removing the pressing force of the slide and descending of the die cushion pad are automatically effected in parallel to each other in accordance with the demand preliminarily set in the initial condition setting thereby permitting the time required for the changing of the die assemblies to be shortened while the simultaneous changing of the die assemblies in the entire press line and the changing of the die assemblies in individual presses are automatically carried out.

By the present invention, the changing of die assemblies in the entire press line can be automatically and simultaneously carried out while the changing of die assemblies in individual presses can be automatically carried out.

Further, the changing of the die assembly in a press can be carried out in parallel to the pressing operation of the press thereby shortening the time for die changing so that the efficiency of the press line is improved.

Further, the operation by the operator is simplified and safety in operation is insured thereby preventing damage to the die assemblies and the parts of the press.

With the present invention, a skilled die setting operator is no longer required.

BRIEF DESCRIPTION OF THE DRAWINGS

FIGS. 1A to 1D are a block diagram showing the sequence of the automatic changing of the die assemblies;

DETAILED DESCRIPTION OF THE PREFERRED EMBODIMENT

Figure 1C:
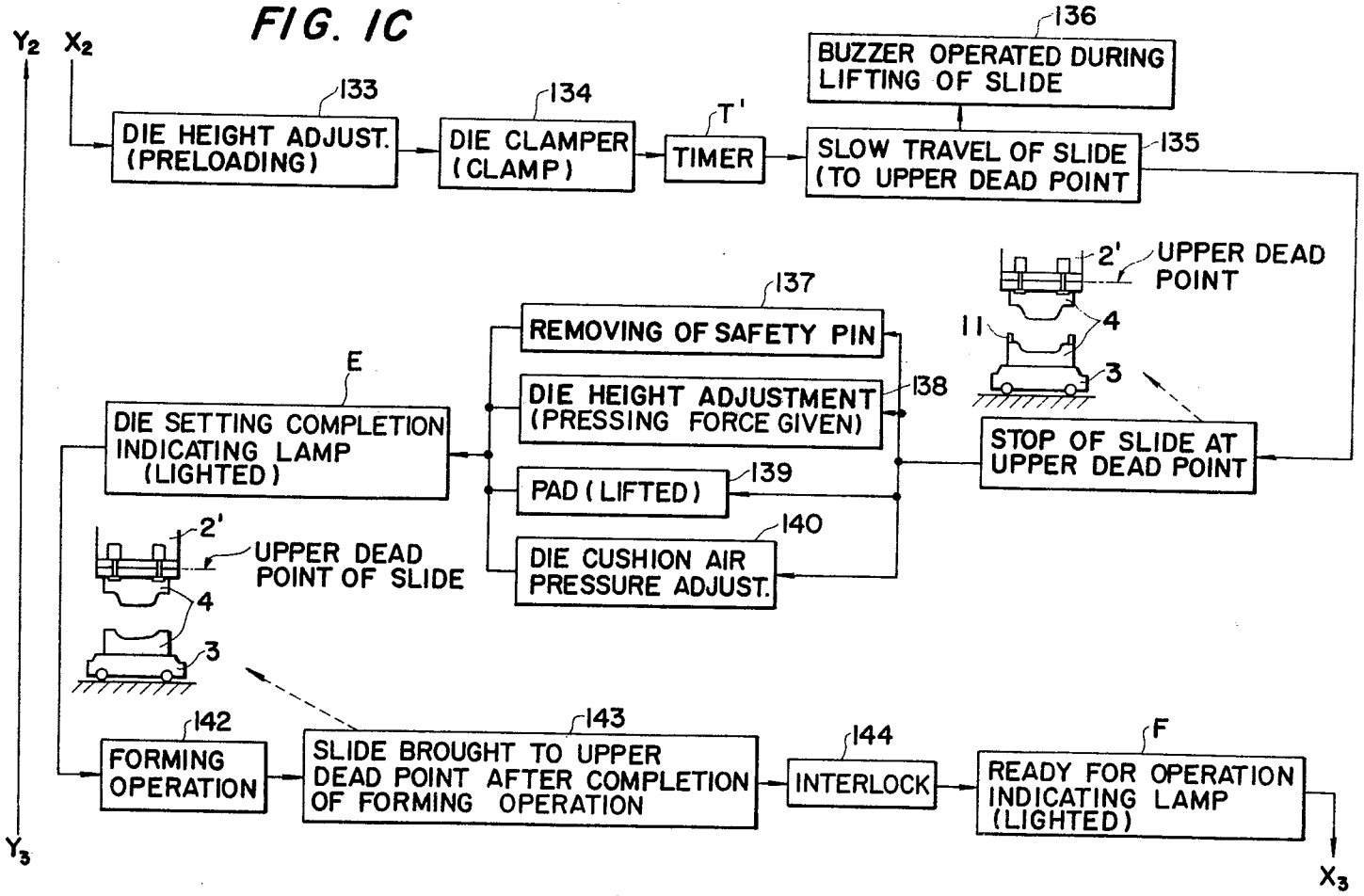
Figure 1D:
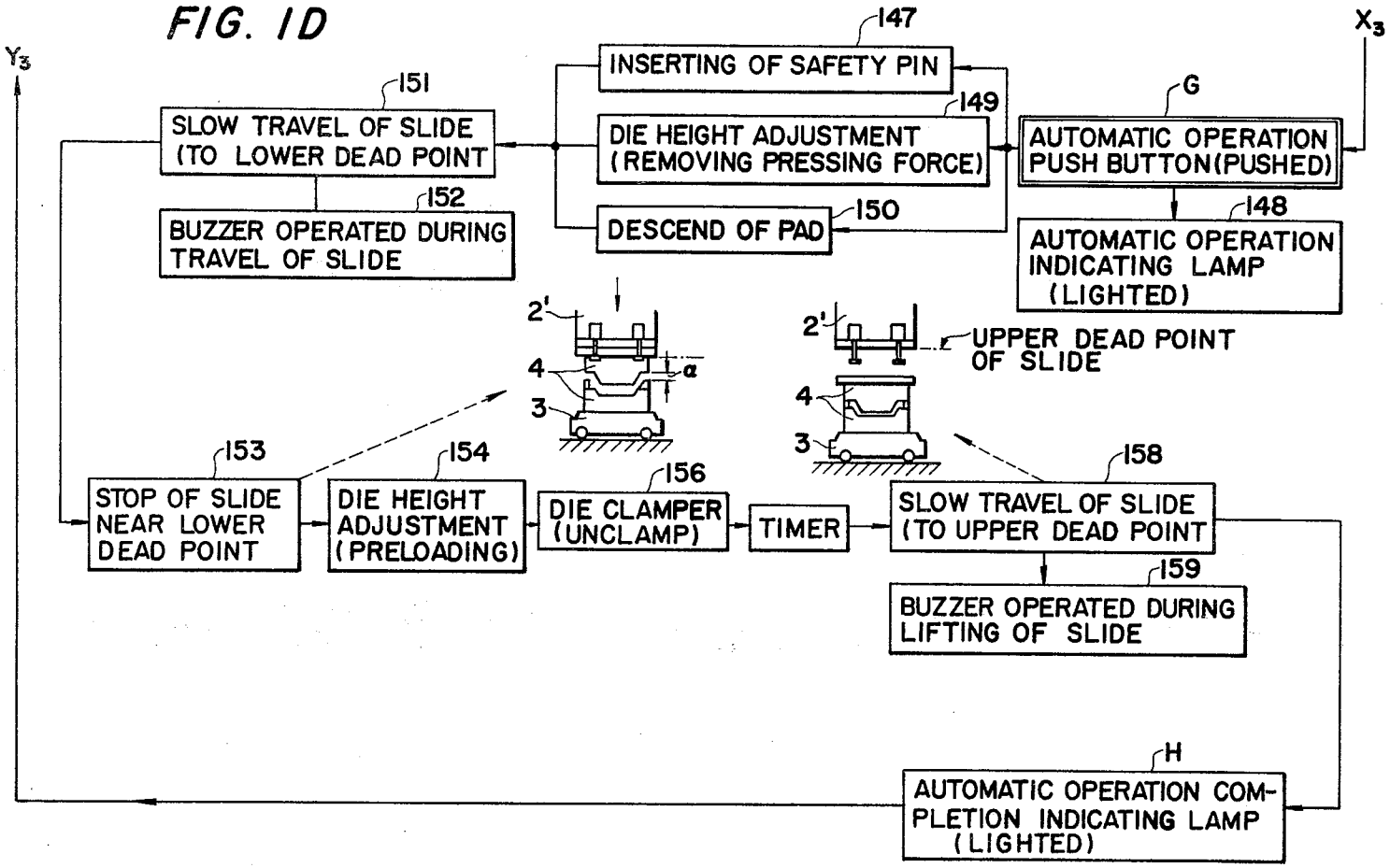

FIGS. 1A to 1D show the block diagrams for carrying out the steps of the automatic die changing operation in accordance with the present invention.

An initial condition setting device A is adapted to set the parameters in the operation intended such as the kind of die to be used, the number of products to be produced, the pressing force of the slide (infeed of the slide for achieving the pressing force), the die height for the die assembly to be used, the balancer air pressure, the die cushion stroke for the die assembly to be used, the die cushion air pressure, the kind of operation of the die cushion (drawing, locking, shearing, etc.) and the blank holder air pressure.

The operation is commenced after setting the respective values in the initial condition setting device A.

Upon receipt of the signal from the interlock 100, the ready for operation indicating lamp B is lit, wherein the die assembly 1 having been used in the previous pressing operation is placed on the moving bolster 2 located in place in the press body and the slide 2' of the press is positioned at the upper dead point while the other bolster 3 is placed in position at the exteriorly set position outside of the press body with a new die assembly 4 to be used in the next operation being placed thereon.

According to the die setting program, when the automatic operation push botton C is manually actuated, the die height adjustment 101 (providing a clearance $\alpha$ between the lower surface of the slide 2' when located at the lower dead point and the upper surface of the adapter attached to the upper die of the new die assembly placed on the bolster 3), the balancer air pressure adjustment 102, the die cushion stroke adjustment 103, the blank holder air pressure adjustment 104 and the die clamper unclamping operation 111 are effected automatically, and then the interchanging of the bolsters 3 and 2 into and out of the press body is carried out in accordance with the program.

The moving bolster 2 is first moved to cross point 5 with high accuracy. To this end, the moving bolster 2 is stopped adjacent to the cross point by stopping the driving motor by means of a limit switch 6, and thereafter, the motor is again driven for a time T so that the bolster 2 is abutted against a positioning stopper 7 and is held at this abutted position during the time set in the timer T, the motor being then deenergized.

Then, the bolster 2 is brought (116) to the exteriorly set position (120) outside of the press body while the bolster 3 is moved (118) to the cross point (121). The buzzers are operated (117) (119) while the bolsters 2 and 3 are moved.

The bolster 3, after being stopped precisly at the cross point, is moved (123) into the press body during the movement of which a buzzer is operated (124).

The bolster 3 is moved in position to the set position in the press body (126) and the bolster lifter descends (127) and the bolster clamper clamps the bolster (128).

After clamping of the bolster 3 and upon receipt of the signal from the interlock 129, the slide 2' of the press is moved at low speed to the lower dead point (130) during which movement the buzzer is operated (131).

In order to prevent damage or interference between the lower surface of the slide 2' and the upper surface of the adapter 3' of the upper die on the bolster 3 positioned in position in the press body due to misadjustment of the die height setting and the like when the slide descends to the lower dead point, interference preventing limit switch 8 provided in the slide 2' is actuated when the clearance 10 between the slide and the adapter reaches a predetermined set value so that the slide 2′ is stopped in emergency operation.

When the slide 2′ reaches a position adjacent to the lower dead point (132), the operation is switched to preloading step (133) so that the slide position adjusting motor is driven to independently lower the slide from the crank mechanism of the press thereby permitting a predetermined pressing force to be applied to the slide 2′ by the close pressing contact of the slide with the adapter which contact is detected by a detecting switch 9 in the slide thereby stopping the adjusting motor. After confirmation of the actuation of the switch 9, the die clampers in the slide 2′ clamp the adapter 3′ of the upper die (134).

Then, the timer T′ operates to provide a predetermined timing, and then, the slide 2′ is lifted by motor of the slide lifter to the upper dead point in the forward or reverse rotation of the crank in the press effected by the motor (135) depending upon the position of the slide which is stopped adjacent to the lower dead point by detecting the actuation or non-actuation of the lower dead point limit switch by the crank. The buzzer is operated during the movement of the slide (136).

Thereafter, so as to be ready for operation, the removal of safety pins in the die assembly (137), the die height adjustment (providing a pressing force or infeed to the slide) (138), the lifting of the die cushion pad (139) and the die cushion air pressure adjustment (140) are carried out for the die assembly set in the press.

After all the steps described above have been completed, the die setting completion indicating lamp E is lit so as to indicate the readiness of the press for pressing operation.

After completion of the pressing operation (142) of the set number of the products, the slide is brought to the upper dead point (143). Upon receipt of the signal from the interlock (144), the ready for die changing operation lamp F is lit.

Thereafter, automatic operation push button G is manually operated so that the indicating lamp is lit (148) to indicate that the die changing operation has commenced.

The die changing operation is initiated by first moving or projecting the safety pins to the operable positions (147), the adjusting die height (removing the pressing force or infeed of the slide) (149), and the descending of the die cushion pad (150).

After confirmation of the completion of the above steps, the driving motor of the slide lifter is operated to move the slide to the lower dead point (151) during which movement the buzzer is operated (152). When the slide stops adjacent to the lower dead point whether or not the slide has been moved beyond the lower dead point the die height adjustment for removing the pressing force or infeed of the slide has already been effected. The operation is switched to the preloading operation (154) so that the slide adjusting motor is driven so as to lower the slide independently from the crank of the press. When the upper die closely contacts with the projected safety pins 11 to produce a predetermined pressing force, the motor is stopped by the actuation of the zerospeed switch, and the die clamper unclamps the adapter 3′ (156) so as to separate the same from the slide. A limit switch is operated upon completion of the unclamping of the die clamper so that a timer is actuated to provide a predetermined timing and, thereafter, the slide 2′ is moved by the driving motor to the upper dead point (158) in the forward or reverse rotation of the motor depending upon the position of the crank whether beyond the lower dead point or not. During the movement of the slide 2′, the buzzer is operated (159). When the slide 2′ has been moved to the upper dead point, the automatic operation completion indicating lamp H is lit to indicate the ready condition for the next die changing operation by interchanging the moving bolsters.

In the above described automatic die changing operation, the die height adjustment for removing the pressing force or infeed of the slide may be dispensed with. In this case, the slide is stopped before it reaches the lower dead point with a clearance corresponding to the infeed of the slide for providing the pressing force to the slide being left between the upper and lower dies, and the slide is lowered by the slide adjusting motor independently of the slide to provide the predetermined pressing force to the upper die for separating the adapter from the slide by unclamping the clamper.

In order to deal with the repair of the die assembly or the repair or adjustment of the automatic devices in the system during the pressing operation, manual operation is also made possible in the control circuit of the present invention.

In FIGS. 1A to 1D, single line blocks show the automatic operation while double line blocks show the manual operation.

As to the control circuit of the present invention, an electronic computer, pin board system or stepping programmer may be utilized.

Now automatic adjustment in each part of the system of the present invention will be described.

1. Die height and die cushion stroke adjustment

Figure 2:
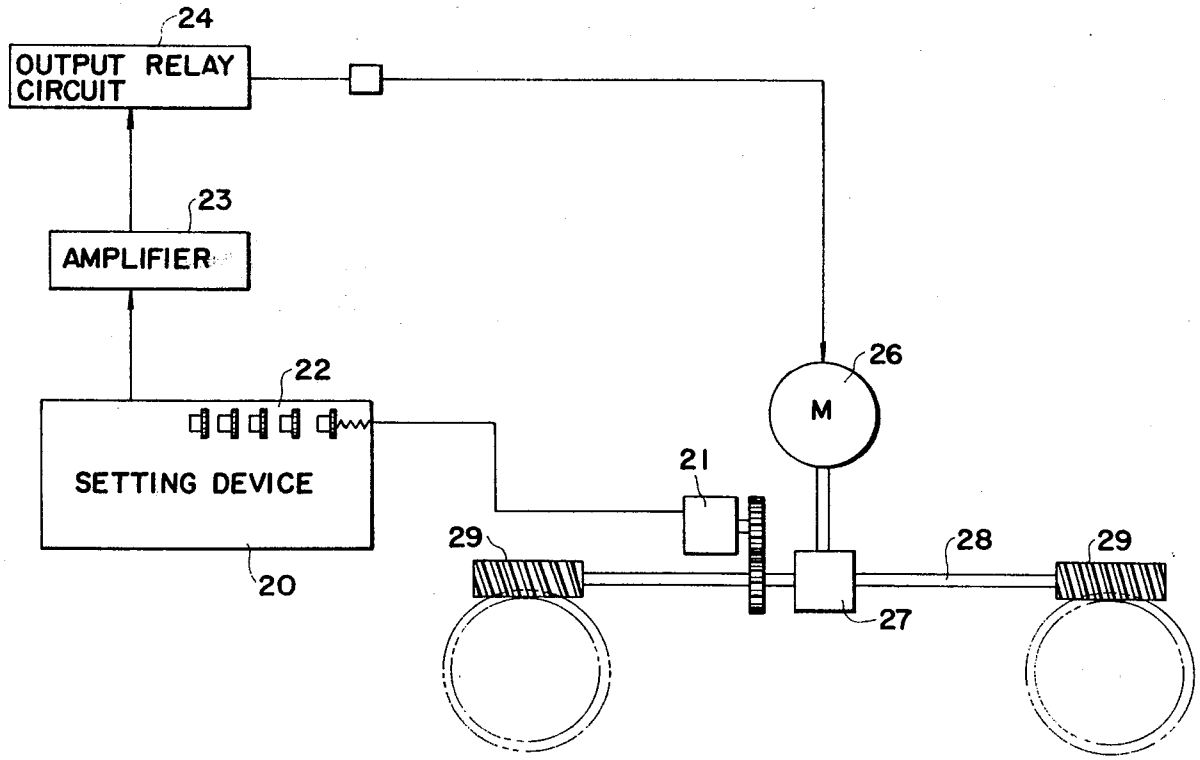
FIG. 2 is a block diagram showing the automatic adjustment of the die height and die cushion stroke.

As shown in FIG. 2, the die height adjusting motor 26 is coupled with the slide (not shown in FIG. 2) through a reduction gear 27, the shaft 28 and worm gears 29 with which the worm wheels for driving the slide through adjusting nuts (not shown) for adjusting the position of the slide are coupled. The initial condition setting device 20 is connected to the motor 26 through an amplifier 23 and an output relay circuit 24 while a slide position detecting device 21 coupled with the shaft 28 is connected to the setting device 20 as shown.

The setting device 20 comprises digital switches 22 for setting the required value of the die height.

Thus, when the die height is set by operating the digital switches 22, the synchronizing control transformer (not shown) in the setting device 20 is operated to provide the required rotating angle. On the other hand, the position detecting device 21 provides the rotating angle corresponding to the actual position of the slide. Therefore, when starting button of the setting device 20 is pushed, a differential voltage having one or an opposite polarity corresponding to the difference in the rotating angle between the detecting device 21 and the setting device 20 is produced, which is amplified by the amplifier 23 discriminating the polarity of the differential voltage, and the output relay 24 is actuated. The output relay 24 operates the motor 26 so that the differential angle between the set value and the value of the detecting device 21 is reduced to zero.

Therefore, the worm wheels are driven by the motor to actuate the adjusting nuts relative to the connection screws for adjusting the slide position to provide the required die height. In adjusting the slide position, the slide is first stopped at a position several millimeters spaced from the set position before it reaches the set position, and the motor 26 is driven intermittently with the aid of a timer so as to permit the slide to be positioned at the set position accurately.

2. Automatic adjustment of air pressure in an air tank for the balancer, die cushion and blank holder.

Figure 3:
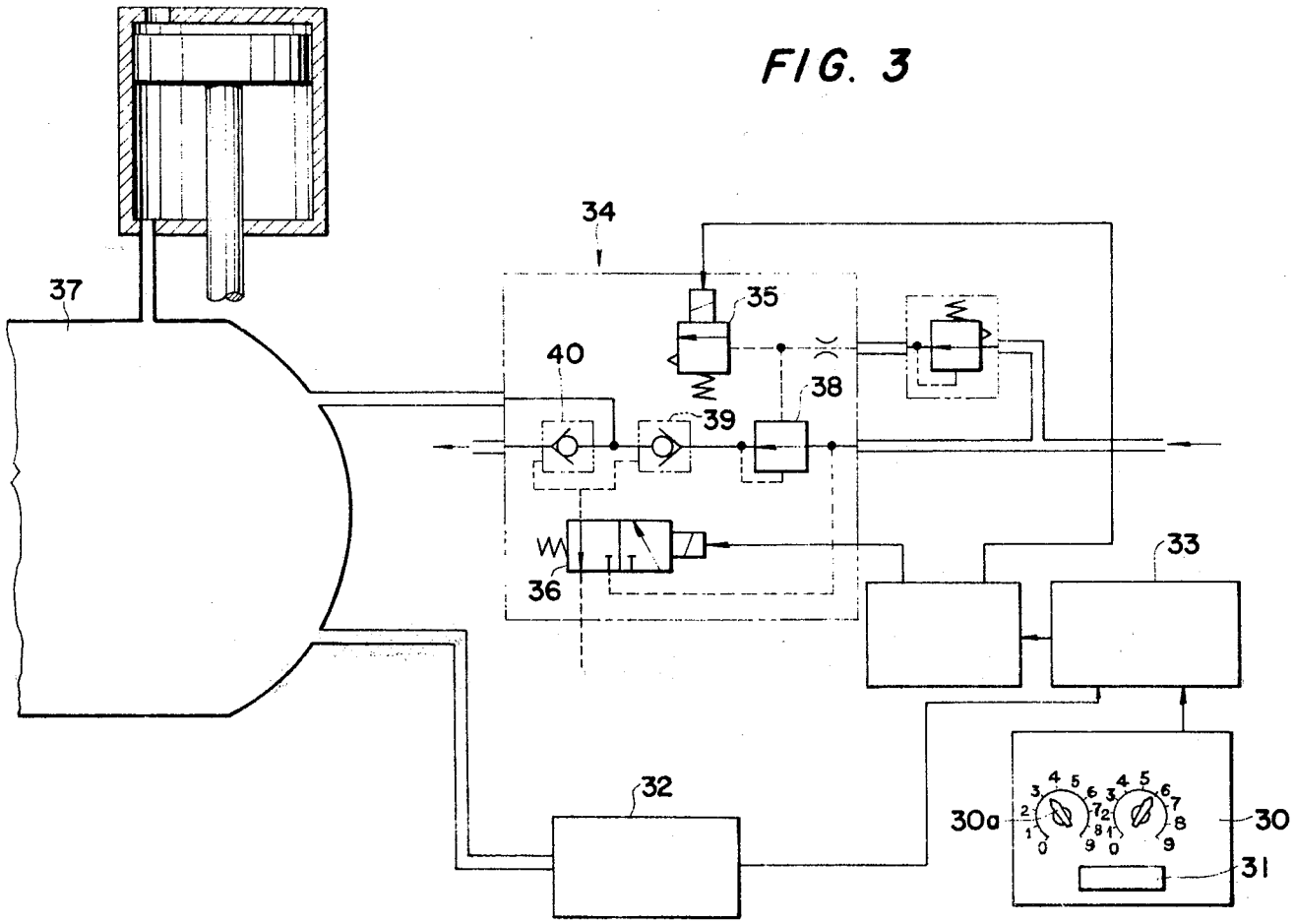
FIG. 3 is a schematic view showing the automatic adjusting device for air pressure in an air tank for balancer, die cushion and blank holder.

As shown in FIG. 3, an air tank 37 for supplying air pressure to the balancer, the die cushion and the blank holder is connected to voltage controlled pressure reducing valve unit 34, and the unit 34 is controlled by a comparator supplier 33 to which signals from the setting device 30 and from the detecting device 32 connected to the air tank 37 are applied for the comparison of these signals.

The voltage controlled pressure reducing valve unit 34 comprises an electrically controlled servovalve 35 and a discharging electromagnetic valve 36, a pilot type pressure reducing valve 38, and check valves 39 and 40 arranged as shown.

The setting device 30 comprises dials 30*a* for setting the required value and a start button 31.

Thus, when the required air pressure is set in the setting device 30 by operating the dials 30*a*, a voltage corresponding to the set value of the air pressure is generated. On the other hand, the detecting device 32 is adapted to convert the air pressure in the tank 37 into a voltage corresponding to the air pressure in the tank 37.

Therefore, upon actuation of the start button 31, the voltage generated by the setting device 30 and the voltage from the detecting device 32 are applied to the comparator amplifier 33 where the two voltages are compared and amplified, and the output is supplied to the voltage controlled servovalve 35 and the electromagnetic valve 36.

If the set value is higher than the air pressure in the tank 37, the differential voltage corresponding to the difference in the pressure is applied to the servovalve 35 so as to adjust the pilot air pressure in the pilot reducing valve 38. The valve 38 is opened by the pilot air pressure so that the supplied air pressure forcibly opens the check valve 39 so as to supply air into the tank 37. When the differential voltage is reduced to zero by the supply of air into the tank 37, the pilot valve 38 is closed, so that the pressure adjustment is completed.

To the contrary, if the set value is lower than the actual air pressure in the tank 37, the differential voltage corresponding to the difference in the pressures is applied to the servovalve 35 and the discharging electromagnetic valve 36. Since the set value is lower than the actual air pressure in the tank 37, the pilot value 38 will not be opened even though the pilot air pressure is applied thereto. On the other hand, the electromagnetic valve 36 is actuated by the voltage applied thereto so that the check valve 40 is forcibly opened to permit the air in the tank 37 to be discharged through the opened check valve 40. When the differential voltage is reduced to zero by the discharge of air from the tank 37, the electromagnetic valve 36 is deenergized to close the check valve 40 so that the adjustment of air pressure in the tank 37 is completed.

3. Attachment and detachment of the fluid connection between the press body and the die assembly.

Figure 4:
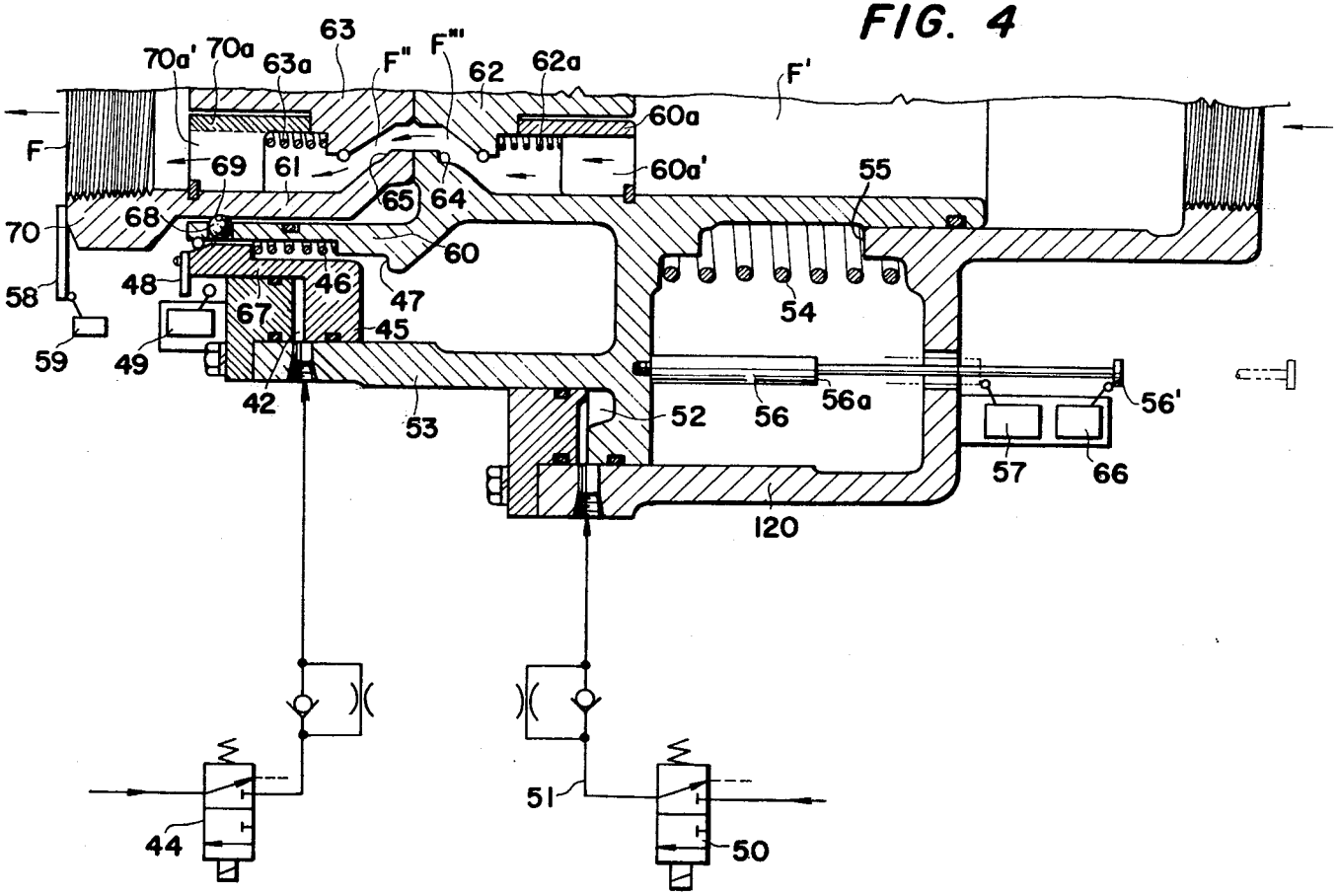
FIG. 4 is a schematic sectional view showing the automatic coupling device for connecting and disconnecting the die and the press body.

As shown in FIG. 4, a cylindrical member 120 is attached to the press body (not shown) for supplying working fluid through passage F′. The member 120 slidably receives therein a double walled cylindrical movable member 53 which is urged by a spring 54 toward the left in FIG. 4 so that an annular fluid chamber 52 formed between the members 120 and 53 is contracted. A cam rod 56 secured to the member 53 extends through the bottom wall of the member 120 and is provided with a shoulder 56*a* at the intermediate portion thereof and an enlarged portion 56′ at its outer end. Limit switches 57, 66 are arranged near the path of movement of the cam rod 56 so that the limit switch 57 is actuated by the shoulder 56*a* when the rod 56 moves to the right while the limit switch 66 is actuated by the enlarged portion 56′ when the rod 56 moves to the left in FIG. 4.

The movement of the member 53 is limited by the contraction of the fluid chamber 52 and a stopper 55 formed in the member 120.

The outer cylindrical wall portion of the member 53 slidably receives and annular piston 67 so that an annular fluid chamber 42 is formed between the end wall of the member 53 and the outwardly extending annular flange 45 of the piston 67. The piston 67 is urged by a spring 46 to the left so as to contract the fluid chamber 42.

The inner cylindrical wall 60 of the member 53 is adapted to slidably receive a coupling body 70 of the die assembly (not shown) when the die assembly is moved in position in the press body. The coupling body 70 is formed with an annular abutment surface 65 at the outer end thereof which is adapted to abut against the mating annular abutment surface 64 formed in the inner surface of the inner wall 60 when the coupling body 70 is moved in the inner wall 60.

The movement of the piston 67 is limited by a cam 48 secured thereto and a stopper 47 formed in the outer surface of the inner wall 60.

The coupling body 70 has a concentric annular guide member 70*a* secured to the inner surface of the body 70 by spokes 70′*a*, and an abutment member 63 is slidably received in the guide member 70*a* and urged by a spring 63*a* so as to extend beyond the abutment surface 65 and normally close the annular passage F″ formed between the abutment surface 65 and the member 63.

In like manner, a concentric annular guide member 60*a* is secured to the inner surface of the inner wall 60 by spokes 60′*a* and an abutment member 62 is slidably received in the guide member 60*a* and urged by a spring so as to extend beyond the abutment surface 64 and normally close the annular passage F‴ formed between the abutment surface 64 and the member 62.

A ball 68 is arranged in a slot in the inner wall 60 which is received in a slot 69 formed in the outer surface of the body 70 when the same is positioned in position in the inner wall 60. The ball 68 is urged in the slot 69 by the piston 67 when the same is moved to the left so that the connection between the body 70 and the inner wall 60 is insured.

As is evident, when the body 70 is moved into the inner wall 60 and abutment surfaces 65, 64 are abutted, the members 62, 63 are abutted so as to be urged against the action of the springs 62*a*, 63*a*, thereby opening the passages F″, F‴ to communicate the passage F′ with the passage F in the body 70.

A limit switch 49 is located adjacent to the cam 48 so as to be actuated by the cam 48 when the piston 67 moves to the right. In like manner, a cam 58 is secured to the coupling body 70 which actuates a limit switch 59 when the coupling body 70 is moved in position in the inner wall 60.

The fluid chamber 42 is connected by line 43 to a source of working fluid (not shown) through a solenoid valve 44 and a parallel circuit of an orifice and a check valve while the fluid chamber 52 is connected by line 51 to the source of fluid through a solenoid valve 50 and a parallel circuit of an orifice and a check valve.

The connection between the limit switches and the solenoid valves described above as follows:

Energization of the solenoid valve 44 causes the working fluid to be introduced into the fluid chamber 42 through the line 43 so as to move the piston 67 to the right against the action of the spring 46 until the piston 67 abuts against the stopper 47. At this time, the cam 48 actuates the limit switch 49 so that the solenoid valve 50 is energized to admit the fluid into the fluid chamber 52 through the line 51 thereby moving the movable member 53 to the right against the action of the spring 54 until the member 53 abuts against the stopper 55. At this time, the limit switch 57 is actuated by the shoulder 56*a* of the rod 56 so that the die assembly on the moving bolster to be used in the next operation is moved into position in the press body, i.e., the coupling body 70 is moved into the inner wall 60 of the movable member 53. At this time, the limit switch 59 is actuated by the cam 58 so as to deenergize the solenoid valve 50 thereby discharging the fluid from the fluid chamber 52 through the line 51 so that the movable member 53 is moved to the left by the action of the spring 54. By this movement, the abutment members 62, 63 first abut against each other so as to open the passages F'', F''', and then the abutment surfaces 64, 65 abut against each other to communicate the passage F' with the passage F.

The movement of the movable member 53 to the left causes the enlarged portion 56' of the rod 56 to actuate the limit switch 66 thereby deenergizing the solenoid valve 44 so as to discharge the fluid from the fluid chamber 42 through the line 43. Thus, the piston 67 is moved to the left by the action of the spring 46 so that the ball 68 is urged into the slot 69 to insure the positive coupling of the coupling body 70 with the member 53 while the passage F' is held communicated with the passage F.

4. Actuation of safety pins for protection of die assembly

Figure 6:
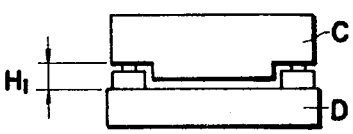
FIGS. 6 and 7 are side views showing the safety pins in the die assembly in different positions.
Figure 7:
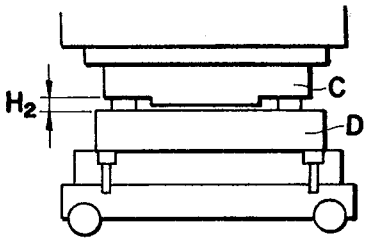

As shown in FIG. 6, the die assembly comprising upper and lower dies C, D is held apart by the safety pins by the distance $H_1$, while the die assembly is stored for preventing interference between the upper and lower dies C, D and to prevent fatigue of the springs and the like incorporated in the die assembly.

When the die assembly is used for a pressing operation, the safety pins are removed or retracted so tha the distance between the upper and lower dies C, D is made $H_2$ ready for operation.

The safety pin assembly comprises safety pin 75 having its piston 75*a* slidably received in a bore of safety pin block 99. The piston 45*a* engages with a spring 98 so as to be urged upwards so that the fluid chamber 89 formed in the bore above the piston 75*a* is contracted.

Figure 5:
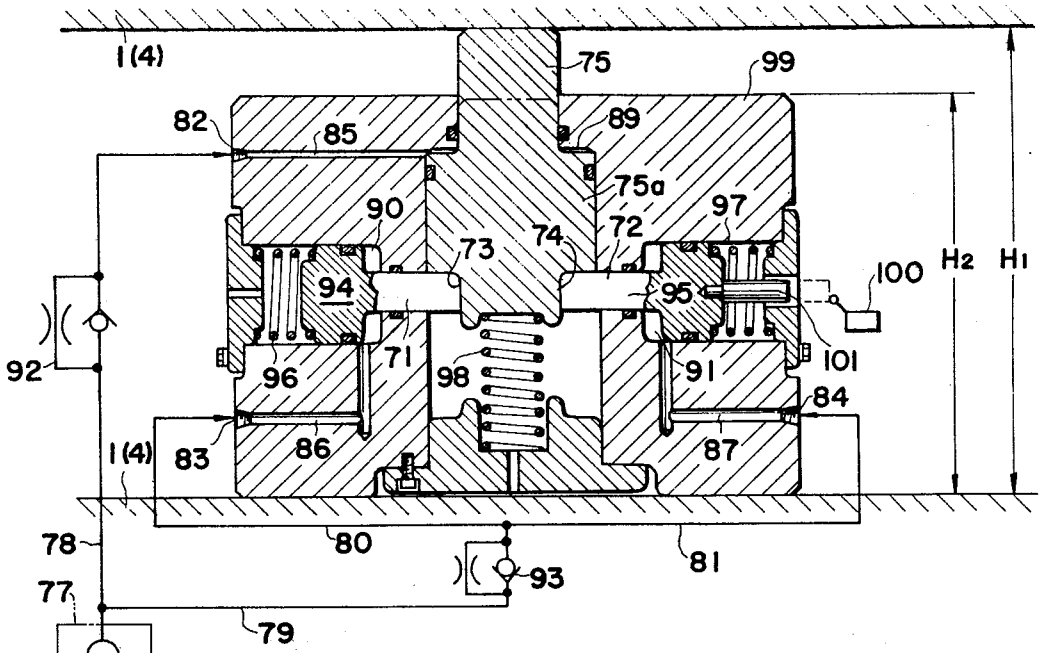
FIG. 5 is a schematic sectional view showing the automatic setting device for the safety pins in the die assembly.

A pair of oppositely arranged pistons 94, 95 are located at a right angle to the piston 75*a* and slidably received in bores in the block 99 as shown in FIG. 5 and they are urged by springs 96, 97 towards the piston 75*a* so that the stems 71, 72 of the pistons 94, 95 are normally received in the recessed engaging portions 73, 74 formed in the piston 75*a* thereby holding the safety pin 75 in its raised or operable position. Fluid chambers 90, 91 are formed between the inner surfaces of the pistons 94, 95 and the bores receiving the pistons, respectively, and the chambers 90, 91 communicates with passages 86, 87 opening at 83, 84 in the block 99, respectively, while the fluid chamber 89 communicates with opening 82 of the block 99 through passage 85.

The piston 95 is provided with a rod 101 extending outwardly from the block 99 and a limit switch 100 is located adjacent to the rod 101 so that it is actuated by the rod 101 when the piston 95 is moved to the right in FIG. 5.

A fluid source (not shown) is connected to the opening 82 through a solenoid valve 76, the coupling 77 (shown as being constructed by the coupling body 70 in FIG. 4), a line 78 and a parallel circuit 92 consisting of an orifice and a check valve, when the die assembly is positioned in the press body for operation. The source is also connected to the openings 83 and 84 through the solenoid valve 76, the coupling 77, a line 79 and a parallel circuit 93 of an orifice and a check valve and lines 80, 81, respectively.

In operation, when the safety pin 75 is to be retracted for the operation of the die assembly, the solenoid valve 76 is energized so that the working fluid is introduced through the coupling 77, lines 78, 79, 80, 81 to the openings 82, 83 and 84, and then into the fluid chambers 89, 90, 91 through passages 85, 86 and 87, respectively. In this case, the fluid chambers 90, 91 are first expanded by the throttling of the parallel circuits 92, 93 so that the pistons 94, 95 are moved apart from each other against the action of the springs 96, 97 thereby disengaging the stems 71, 72 from the engaging portions 73, 74 in the piston 75*a*. Then, the fluid chamber 89 is expanded by the fluid introduced thereinto by the throttling of the parallel circuit 92 so that the piston 75*a* is moved downwardly against the action of the spring 98 thereby retracting the safety pin 75 into the block 99. Thus, the upper die C comes in contact with the upper surface of the block 99 to be ready for the operation.

When the solenoid valve 76 is deenergized, the fluid is discharged from the fluid chambers 89, 90, 91. Thus, the safety pin 75 is raised by the spring 98 and the piston 94, 95 are moved toward each other so that the stems 71, 72 engage with the engaging portions 73, 74, respectively, so as to arrest the safety pin 75 in its operative position.

The limit switch 100 is connected to the control circuit of the press and serves to prevent the pressing operation of the press when the limit switch 100 is actuated, i.e., when the safety pin 75 is in the raised or operative position in order to prevent the safety pin 75 from being damaged or broken by the pressing operation.

5. Illuminating device

Figure 8:
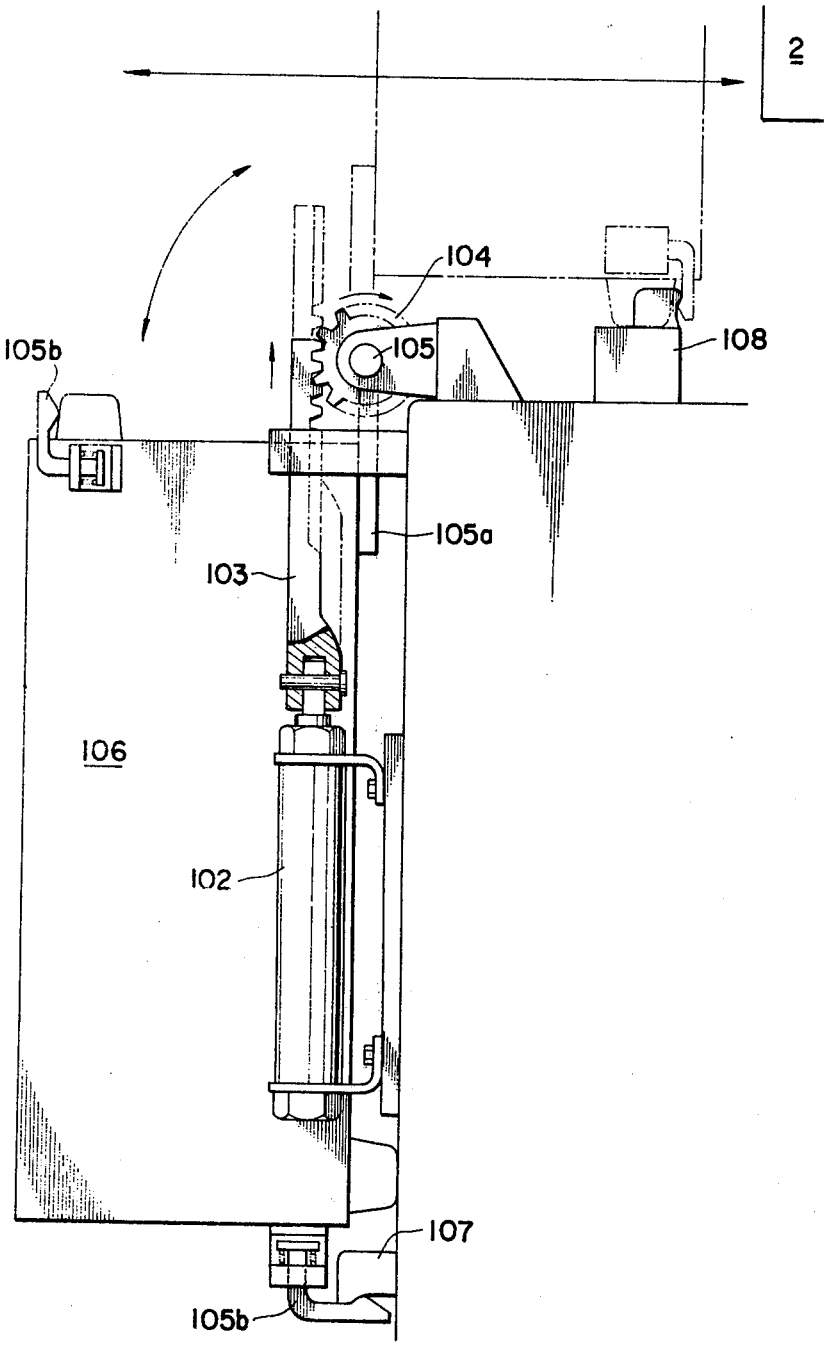
FIG. 8 is a fragmentary side view showing the automatically rotatable illuminating device for illuminating the working area in the press.
Figure 10:
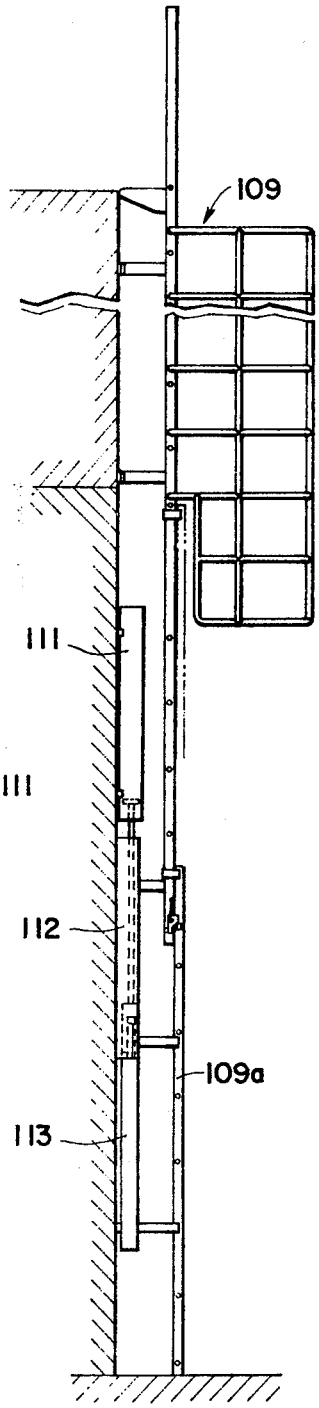
FIG. 10 is a side view of FIG. 9.

As shown in FIG. 8, the illuminating device 106 is rotated to the upright position shown by the two dot chain line in FIG. 8 when the moving bolster is moved in position in the press body for the operation thereof while the illuminating device 106 is rotated to the downwardly rotated position shown by the solid line in FIG. 8 when the moving bolster is moved out of the press body for the die changing operation so as to indicate that the press is in the die changing operation.

To this end, a cylinder 102 is provided on the press body which has a rack 103 connected thereto.

The rack 103 engages with a pinion 104 fixedly secured to a shaft 105 which is in turn rotatably supported by a bracket mounted on the press body. A plate 105*a* is fixed to the shaft 105 and the plate 105*a* mounts thereon the illuminating device 106.

The illuminating device 106 has a pair of locking members 105*b* resiliently mounted at the positions diagonal of the device 106, one of which engages with the latching member 107 when the device 106 is downwardly rotated so as to lock the same in position while the other locking member engages with a latching member 108 when the device is rotated to the upright position as shown in FIG. 8 so as to arrest the device 106 in its position.

In operation, when the bolster is moved to the right in FIG. 8 to the position in the press body for operation, the cylinder 102 is actuated manually or automatically by means (not shown) operably connecting the cylinder 102 for the positioning operation of the bolster so that the rack 103 is moved upwardly to rotate the pinion 104 and the shaft 105 in the direction indicated by the arrow thereby rotating the illumination device 106 in the clockwise direction from the position shown by the solid line to the position shown by the two dot chain line by disengaging the locking member 105*b* from the latching member 107 and locking the same in position by the locking member 105*b* and the latching member 108.

When the moving bolster is to be moved out of the press body, the cylinder 102 is actuated in the reverse direction so that the illuminating device 106 is moved to the position shown by solid line and locked in position by the cooperation of the members 105*b* and 107.

6. Up and down movement of the ladder

In moving the bolster in and out of the press body, the lower upright ladder 109*a* of the ladder assembly 109 for access to the crown of the press must be moved upwardly so as to clear the path of movement of the moving bolster.

Figure 9:
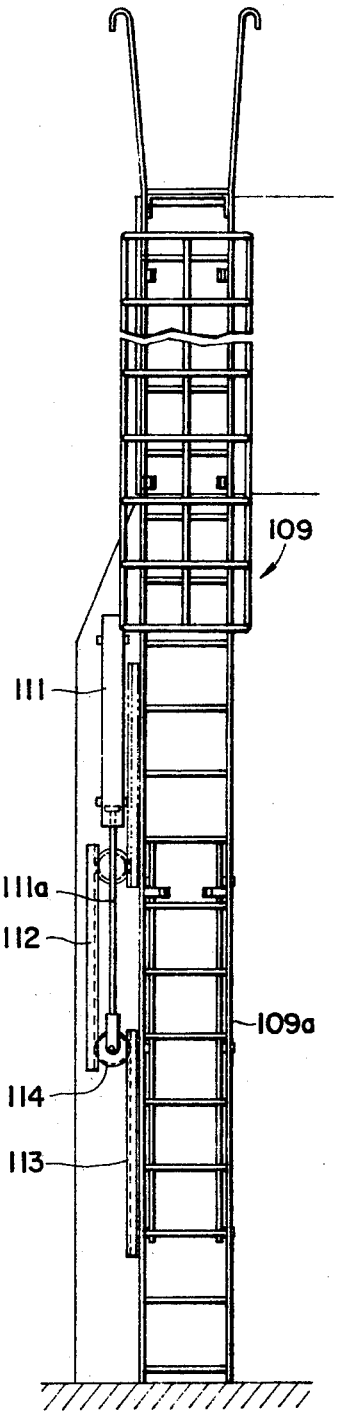
FIG. 9 is a front view showing the liftable ladder of the press of the present invention.
Figure 11:
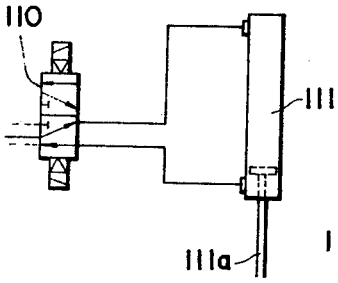
FIG. 11 is a fragmentary diagram showing the circuit of the lifting cylinder shown in FIG. 9.

To this end, a cylinder 111 is mounted on the press body and the piston rod 111*a* thereof is provided with a pinion 114 at its outer end. The pinion is engaged with a stationary rack 112 mounted on the press body at its one side while a rack 113 secured to the up and downwardly movable ladder 109*a* engages with the pinion 114 at the other side as shown in FIG. 9. The cylinder 111 is connected to a source of fluid through an electromagnetic valve 110 as shown in a FIG. 11.

In operation, when the moving bolster is moved in or out of the press body, the electromagnetic valve 110 is actuated so that the cylinder 111 is operated to retract the piston rod 111*a* . Thus, the ladder 109*a* is moved upwardly by the engagement of the pinion 114 with the racks 112, 113.

In the apparatus of the present invention, a device is provided beneath the bolster in order to collect the scrap generated by the pressing operation and dust from the upper surface of the rails.

Since the present invention is constructed as described above, the die changing operation in the entire press line can be carried out fully automatically and simultaneously, and the die changing operation in an individual press can also be effected.

Further, the die changing operation can be effected during the operation of the press thereby shortening the time required for the die changing so that the efficiency is extremely improved. Further, no skill in die changing operation is required to eliminate the skilled operator and to insure safety in operation. Thus, the danger of damaging the die assembly and the parts of the press is avoided.

We claim:

1. Process for automatically interchanging die assemblies, which assemblies are to be used in succeeding operations, in a metal working press in which a first moving bolster is located in a position in the press having mounted thereon a die assembly consisting of an upper die and a lower die which have been used in a preceding operation of the press with the slide of the press being located at the upper dead point thereof and a second moving bolster being located in a position exterior to the press having mounted thereon a die assembly consisting of an upper die and a lower die which are to be used in a succeeding operation of the press, wherein the improvement comprises the steps of adjusting the die assembly on the second bolster including effecting die height adjustment for providing a set clearance for the next die assembly, balancer air pressure adjustment, die cushion stroke adjustment and blank holder air pressure adjustment for the next die assembly according to predetermined set values set for the next operation of the press using the next die assembly on the second bolster upon receipt of an interlocking signal for operating the first and second moving bolsters, moving the first bolster out of the press into position exterior to the set position, moving the second bolster into position in the press, moving the slide which has been located at the upper dead point downwardly to the lower dead point for securing an adapter attached to the upper die mounted on the second bolster to the slide by the clamping action of a die clamper of the slide, moving the slide again to the upper dead point for simultaneously readjusting the die height for applying infeed or pressing force to the slide, lifting a die cushion pad and adjusting the die cushion air pressure, carrying out the pressing operation for producing products in accordance with a predetermined set number, moving the slide again to the upper dead point for adjusting the die height thereby providing a set clearance for the next die assembly, lowering the die cushion pad upon receipt of an interlocking signal for operation of the press and the first and second moving bolsters, moving the slide to the lower dead point for separating the adapter attaching thereto the upper die from the slide by the unclamping action of the die clamper, moving the slide to the upper dead point for readjusting the assembly, and interchanging the die assembly on the first moving bolster located in position at the exterior position with a succeeding die assembly to be used in a succeeding operation, wherein all of the steps are automatically carried out in accordance with a predetermined pattern thereby permitting the changing of the die assemblies to be carried out automatically during the pressing operation by the press.

2. Apparatus for automatically interchanging die assemblies in a metal working press having a pair of moving bolsters alternately used in the press, wherein the improvement comprises means provided with an initial condition setting device for setting the required die height value, a slide position detecting device for actuating a slide driving motor intermittently by means of a timer through a synchronizing control for automatically adjusting the die height and the die cushion stroke, means having a voltage controlled reducing valve unit including a plurality of check valves and a discharging electromagnetic valve for automatically adjusting the air pressure in an air tank for a balancer, die cushion and blank holder, means having a plurality of electromagnetic valves and a coupling body for automatically connecting and disconnecting the flow of working fluid from the press body to the die assembly attached thereto, and means having an electromagnetic valve for automatically setting the die protecting clearance in the die assembly by operating safety pins mounted in the die assembly, wherein a first series of operations including the adjustments of the die height, the blank holder air pressure, the balancer air pressure and the die cushion stroke and the movement of the moving bolsters out of and into the press body, a second series of operations including clearance adjustment for operation of the die assembly, removal of safety pins, die height readjustment for applying a pressing force to the slide, lifting of the die cushion pad and die cushion air pressure adjustment and a third series of operations including readjustment of the clearance for protection of the die assembly, locking of the safety pins, die height adjustment for removing the pressing force of the slide and lowering the die cushion pad are automatically effected simultaneously in accordance with a predetermined pattern thereby permitting the time required for the changing of the die assemblies in a metal working press to be shortened.

* * * * *